US009856053B2

(12) United States Patent
Pisarevsky

(10) Patent No.: US 9,856,053 B2
(45) Date of Patent: Jan. 2, 2018

(54) DETACHABLE STORAGE CONTAINER FOR A DRINKS CONTAINER

(71) Applicant: Eric Pisarevsky, Montreal (CA)

(72) Inventor: Eric Pisarevsky, Montreal (CA)

( * ) Notice: Subject to any disclaimer, the term of this patent is extended or adjusted under 35 U.S.C. 154(b) by 23 days.

(21) Appl. No.: 14/991,162

(22) Filed: Jan. 8, 2016

(65) Prior Publication Data

US 2016/0198874 A1 Jul. 14, 2016

Related U.S. Application Data

(60) Provisional application No. 62/102,042, filed on Jan. 11, 2015.

(51) Int. Cl.

| | |
|---|---|
| ***B65D 77/00*** | (2006.01) |
| ***B65D 21/02*** | (2006.01) |
| ***A61J 7/04*** | (2006.01) |
| ***A61J 7/00*** | (2006.01) |

(52) U.S. Cl.
CPC ..... *B65D 21/0237* (2013.01); *A61J 7/0084* (2013.01); *A61J 7/04* (2013.01)

(58) Field of Classification Search
USPC ..... 206/216, 217, 223, 538
See application file for complete search history.

(56) References Cited

U.S. PATENT DOCUMENTS 4,685,565 A * 8/1987 Sparling ..... B65D 21/0204 206/427
5,002,199 A * 3/1991 Frahm ..... B65D 21/0202 206/509
6,026,974 A * 2/2000 Burt ..... B60K 15/00 220/23.4
6,059,135 A * 5/2000 James ..... B65D 55/145 220/23.4
6,073,757 A * 6/2000 Kornick ..... A45C 11/005 206/223
8,069,986 B2 * 12/2011 Darr ..... B65D 1/0276 206/509
8,794,465 B2 * 8/2014 Okoniewski ..... B60N 3/103 220/23.4
8,973,775 B2 * 3/2015 Shonborn ..... A47G 19/2205 206/217
2001/0030191 A1 * 10/2001 Bopp, III ..... B65D 21/0204 220/23.4
2002/0121454 A1 * 9/2002 Ross ..... A61J 1/03 206/539
2003/0010744 A1 * 1/2003 Ma ..... A61H 15/0092 215/382
2006/0261063 A1 * 11/2006 Dyehouse ..... B65D 21/0204 220/23.4

(Continued)

*Primary Examiner* — Jacob K Ackun

(57) ABSTRACT

A detachable storage container for a drinks container comprising of: a storage container comprising of a plurality of storage compartments; a plurality of lids, each lid attached to a compartment, each lid openable and closable, and a distinguishing mark on each lid; and a slide track on each side of the storage container to attach and detach to and from a drinks container; a drinks container comprising of: a drinks container with a deep wide groove and slide tracks to attach and detach the detachable storage compartments; a drinks container with legs to support the drinks container in a lying position; and a removable cap with a partially flat surface to be used as a drinking cup.

1 Claim, 5 Drawing Sheets

(56) References Cited

U.S. PATENT DOCUMENTS

| | | | | |
|---|---|---|---|---|
| 2008/0296181 | A1* | 12/2008 | Stephens | A47G 23/16<br>206/217 |
| 2009/0050495 | A1* | 2/2009 | Marcus | A61J 1/03<br>206/217 |
| 2009/0255893 | A1* | 10/2009 | Zummo | B65D 1/0223<br>215/10 |
| 2009/0301991 | A1* | 12/2009 | Yarro | B65D 1/0276<br>215/382 |
| 2012/0261283 | A1* | 10/2012 | Anson | B65D 47/243<br>206/221 |
| 2015/0021215 | A1* | 1/2015 | Clark | B65D 23/085<br>206/223 |
| 2016/0143814 | A1* | 5/2016 | Lau | A61J 9/00<br>215/11.1 |

* cited by examiner

DETACHABLE STORAGE CONTAINER FOR A DRINKS CONTAINER

CROSS REFERENCE TO PREVIOUS APPLICATION

This application claims the benefit of the U.S. Provisional Application No. 62/102,042, filed Jan. 11, 2015, the disclosure of which incorporated herein by reference.

STATEMENT REGARDING FEDERALLY SPONSORED RESEARCH OR DEVELOPMENT

Not applicable.

BACKGROUND

Many people use small and portable storage containers as pill dispensers to assist in the management of their medication and vitamin needs. These storage containers may be divided into daily use compartments. Many people ingest their pills with the assistance of a liquid.

Thus there is a need to provide a means for a person to attach and detach the portable storage container to a drinks container to allow the person to have the medication or vitamins and accompanying liquid readily available for daily ingestion in any location at any time.

SUMMARY

The disclosed invention relates to a detachable storage container for a drinks container comprising of: a storage container comprising of: a plurality of storage compartments; a plurality of lids, each lid attached to a compartment, each lid openable and closable, and a distinguishing mark on each lid; a drinks container comprising of: a drinks container with a deep wide groove and slide tracks on each side of the groove to attach and detach the detachable storage container, a drinks container with stabilizing supports on the rear wall of the drinks container to support the drinks container in a lying position, and a removable cap with a partially flat surface which may be used as a drinking cup.

BRIEF DESCRIPTION OF DRAWINGS

The present disclosure will be better understood by those skilled in the pertinent art by referencing the accompanying drawings, where like elements are numbered alike in the several figures, in which.

DETAILED DESCRIPTION

Figure 1:
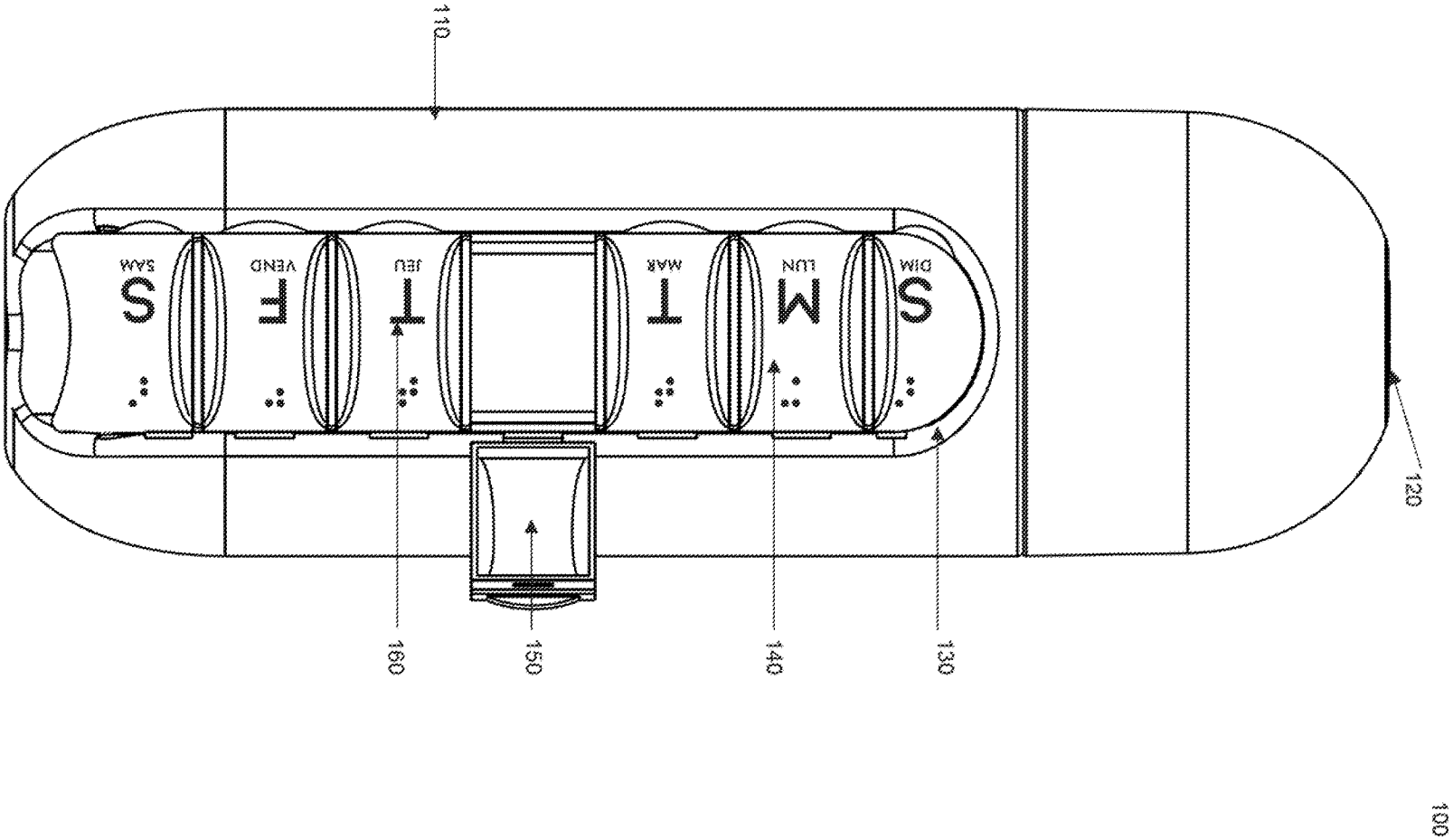
FIG. 1 is a front view of the disclosed detachable storage container attached to the drinks container with one of the storage compartment lids of the detachable storage container in an open position.
Figure 2:
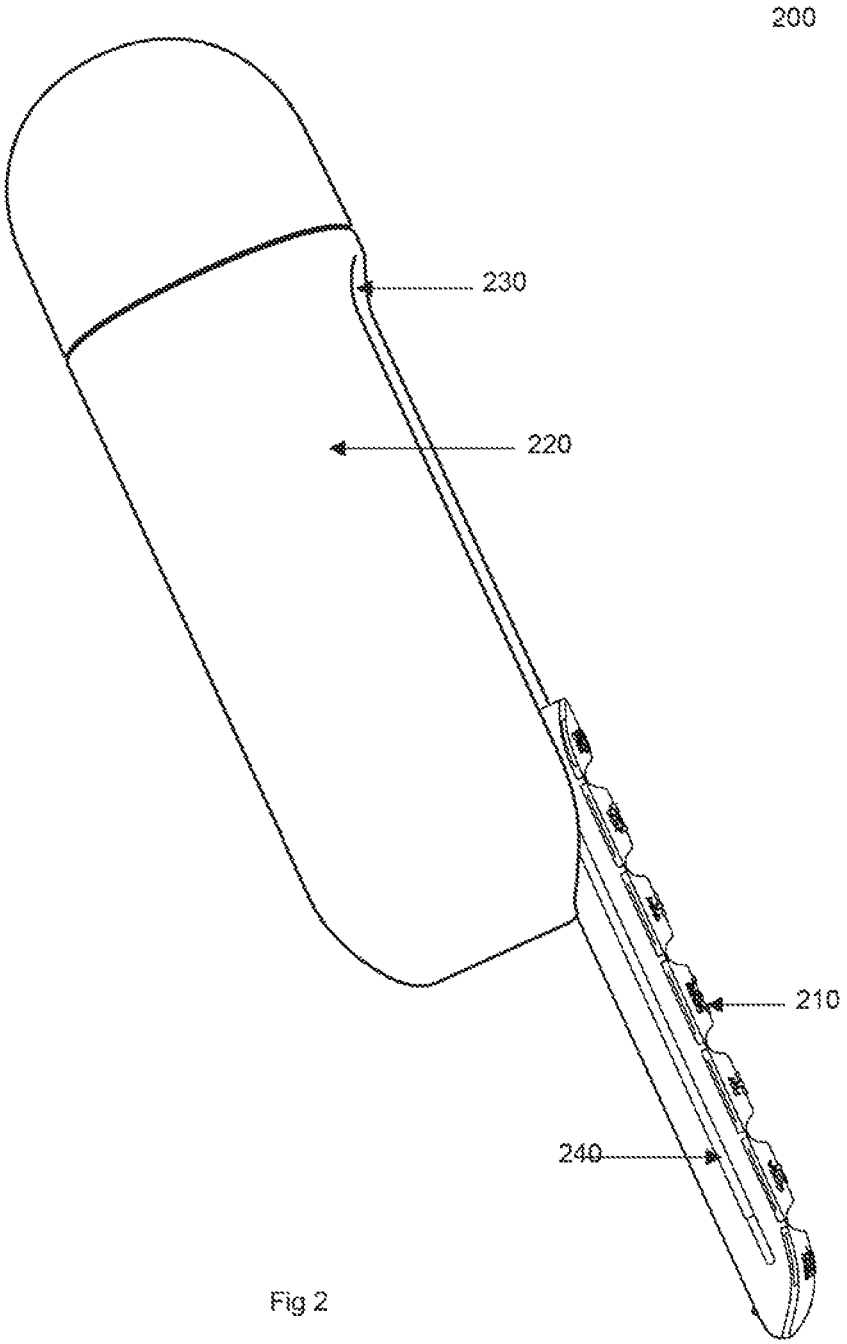
FIG. 2 is an upright perspective view of the detachable storage container detaching from the drinks container.
Figure 3:
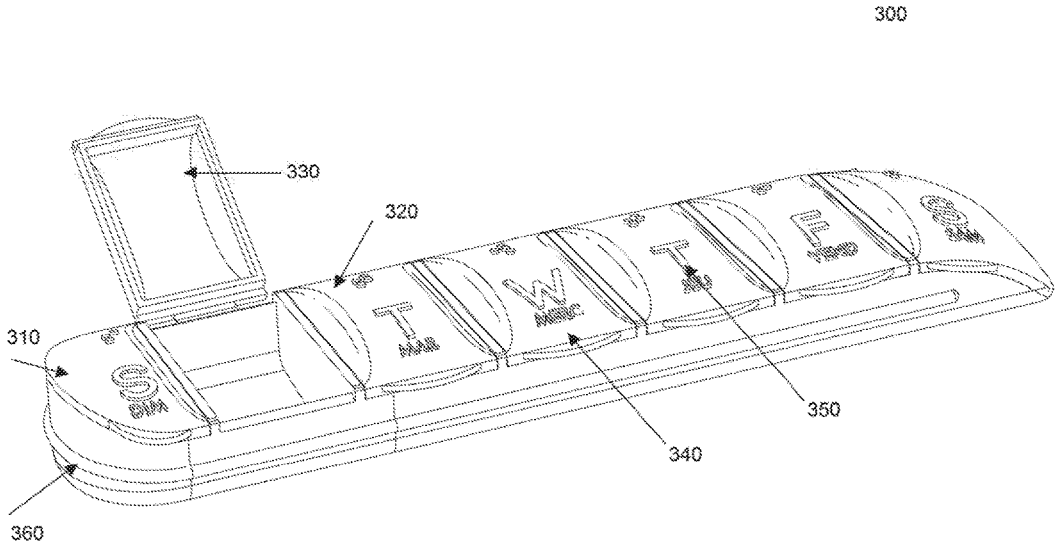
FIG. 3 is a perspective view of the detachable storage container with one of the storage compartment lids in an open position exposing the storage compartment.
Figure 4:
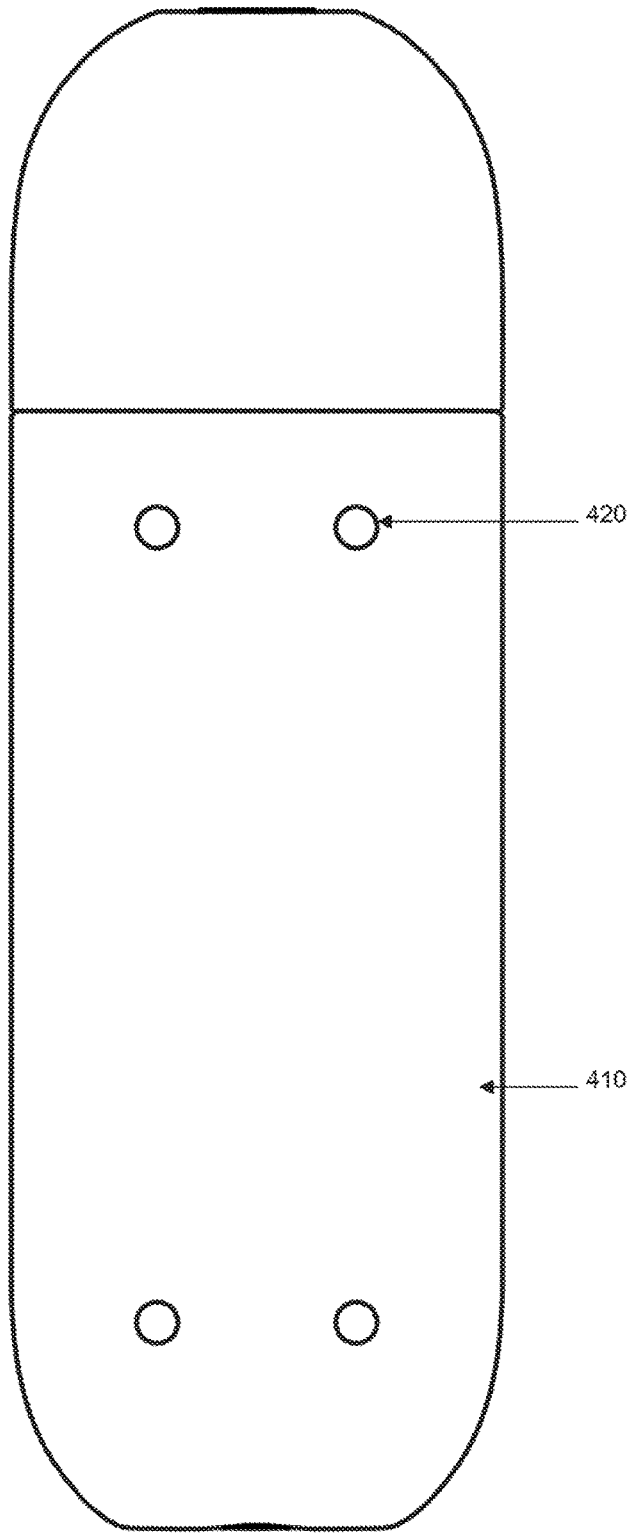
FIG. 4 is a side rear view of the drinks container with the stabilizing supports clearly visible.
Figure 5:
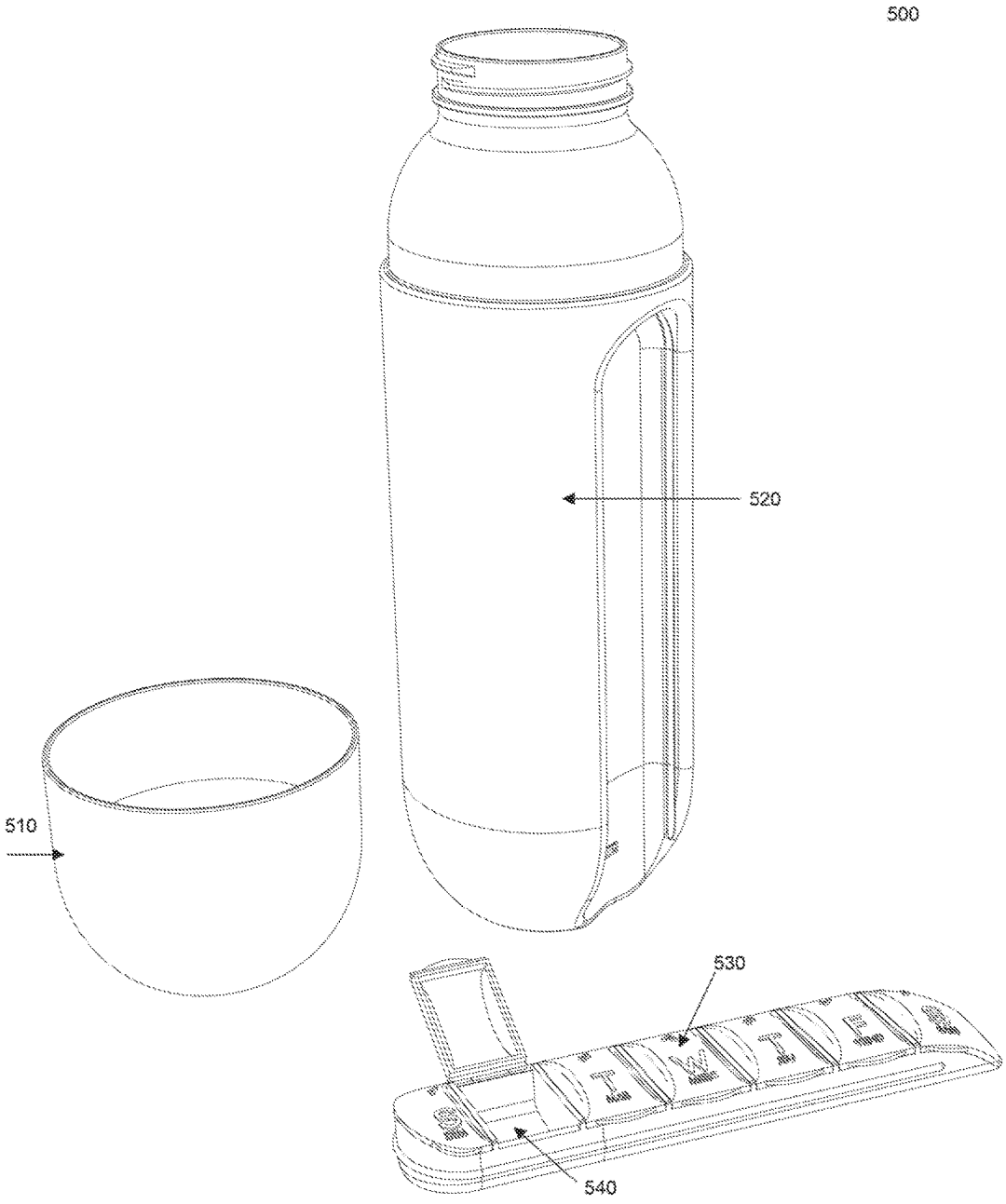
FIG. 5 is a perspective view of the components that may comprise the present invention; the detachable storage container, the drinks container and the cap of the drinks container removed which may be useful as a cup for a drink.

FIG. 1 is the front view of the disclosed detachable storage container and the drinks container [1] 100. The drinks container 110 may comprise of a cap with a flat surface that can be used a cup [2] 120. The detachable storage container [3] 130 may be attached to and detached from the wall of the drinks container [3] 110. The detachable storage container 130 may comprise of a plurality of compartments [4] 140, each of which has a lid 150 which may be opened to allow access to the storage compartment and closed to prevent access to the storage compartment[s]. The lids may be provided with indicia [6] 160, for example indicating days of the week, in order to simplify differentiation therebetween;

FIG. 2 is an upright perspective view of the storage container and the drinks container [1] 200 in which the storage container 210 is shown being detached from the drinks container [2] 220 using a sliding motion along the deep wide groove and slide track 230 of the drinks container [3] 220 and the slide tracks 240 of the storage container [4] 210. [The rear stabilizing supports 5 are shown];

FIG. 3 is a perspective view of the detachable storage container [1] 300. The storage container 310 may comprise of a plurality of compartments [2] 320, with each compartment having a lid that opens [3] 330 to allow access to the storage space in the compartment and doses [4] 340 to prevent access to the storage space in the compartment. The lids may be provided with indicia [5] 350, for example indicating the days of the week, in order to differentiate therebetween. The lid may be of any suitable material or structure. The compartments may be sized so as to each store a small number of pills and, as such, the detachable storage container may be useful as a pillbox. The storage container 310 may have a slide track 360 on each side [6] to allow for sliding in and out of the [storage] drinks container (see FIG. 1) and to attach to and detach from the drinks container (see FIG. 1);

FIG. 4 is a side rear view of the drinks container [1] 410 with the stabilizing supports [2] 420 dearly visible. The [supporting legs] stabilizing supports 420 may serve to support the container in a lying down position when the storage container (see FIG. 1) is being attached to and detached from the drinks container 410 and when the compartments (see FIG. 1) are being accessed; and FIG. 5 is a perspective view of the components 500 that may comprise the present invention. The cap [1] 510 of the drinks container [2] 520 is shown in an upright position which may be used as a cup to drink a beverage, the drinks container [2] 520 and the detachable storage container 530 with one lid open to access the storage compartment 540.

What is claimed is:

1. A detachable storage container with storage compartments and a drinks container comprising:

a detachable storage container, the storage container comprising:

a body having a flat bottom, a side and a top;

a plurality of storage compartments in the body;

a plurality of individual lids on the top of said body, each lid openable and closable over a storage compartment;

indicia on each lid; and slide tracks on the side that are useful to attach and detach the storage container to and from a drinks container;

a drinks container comprising:

a generally cylindrical body for holding drinks, the body having a wall, a top and a bottom;

a deep wide groove in the wall with slide tracks on each side of the groove to interact with the slide tracks of the storage container;

the groove having an opening on the bottom of the drinks container;

the storage container being slidable into and out of the groove through the opening to attach and detach the storage container to and from the drinks container;

stabilizing supports on the drinks container to support the drinks container when attaching and detaching the storage container; and a cap with a flat base, the cap for closing off the top of the drinks container to seal drinks in the drinks container, and for use as a cup to hold drinks for consumption, the flat base for supporting the cap when it is used as a cup.

* * * * *